US006135178A

United States Patent [19]

Fager

[11] Patent Number: 6,135,178

[45] Date of Patent: Oct. 24, 2000

[54] WOOD SPLITTING DEVICE

[75] Inventor: Thomas Fager, Martin, Ohio

[73] Assignee: Faver, Inc., Millbury, Ohio

[21] Appl. No.: 09/328,092

[22] Filed: Jun. 8, 1999

[51] Int. Cl.[7] ..... B27L 7/00

[52] U.S. Cl. ..... 144/195.1; 144/4.6; 144/193.1; 144/195.8; 144/366

[58] Field of Search ..... 144/4.6, 193.1, 144/195.1, 195.7, 195.8, 195.2, 366

[56] References Cited

U.S. PATENT DOCUMENTS

| | | | |
|---|---|---|---|
| 508,221 | 11/1893 | Hill | 144/195.1 |
| 4,033,390 | 7/1977 | Piontkowski . | |
| 4,086,111 | 4/1978 | Corey . | |
| 4,176,696 | 12/1979 | Greeninger . | |
| 4,236,556 | 12/1980 | Smith . | |
| 4,246,941 | 1/1981 | Campbell . | |
| 4,285,374 | 8/1981 | Klingel . | |
| 4,303,112 | 12/1981 | Sconce . | |
| 4,310,039 | 1/1982 | O'Brien . | |
| 4,315,534 | 2/1982 | Blackstone . | |
| 4,331,192 | 5/1982 | Hung . | |
| 4,362,194 | 12/1982 | Lawson | 144/195.5 |
| 4,373,564 | 2/1983 | Heikkinen . | |
| 4,403,635 | 9/1983 | York . | |
| 4,412,570 | 11/1983 | Nickerson . | |
| 4,428,409 | 1/1984 | Roetzler . | |
| 4,432,402 | 2/1984 | Wirsbinski . | |
| 4,446,898 | 5/1984 | Manteufel . | |
| 4,458,737 | 7/1984 | Klug . | |
| 4,470,441 | 9/1984 | Wirsbinski et al. . | |
| 4,487,239 | 12/1984 | Anderson . | |
| 4,491,164 | 1/1985 | Waikas et al. . | |
| 4,501,309 | 2/1985 | Sinden . | |
| 4,537,235 | 8/1985 | Aderneck . | |
| 4,559,985 | 12/1985 | May . | |
| 4,561,479 | 12/1985 | Burdine . | |
| 4,630,659 | 12/1986 | Warthen . | |
| 4,672,006 | 6/1987 | McGraw . | |
| 4,685,495 | 8/1987 | Freeman . | |
| 4,700,759 | 10/1987 | Duerr . | |
| 4,782,868 | 11/1988 | Coller et al. . | |
| 4,782,870 | 11/1988 | Duerr . | |
| 4,799,519 | 1/1989 | Forbes et al. . | |
| 4,829,865 | 5/1989 | Nunnery et al. . | |
| 4,830,070 | 5/1989 | Nunnery et al. . | |
| 4,830,071 | 5/1989 | Gollahon . | |
| 4,834,154 | 5/1989 | Nunnery et al. . | |
| 4,869,303 | 9/1989 | Nunnery et al. . | |
| 4,875,514 | 10/1989 | Hollister, Jr. . | |
| 4,945,960 | 8/1990 | McCauley . | |
| 5,282,501 | 2/1994 | Miller, III . | |
| 5,287,902 | 2/1994 | Jeantelot | 144/195.1 |
| 5,323,822 | 6/1994 | Janczak . | |
| 5,337,810 | 8/1994 | McCormack . | |
| 5,547,001 | 8/1996 | Cumming et al. . | |
| 5,651,404 | 7/1997 | Kraemer et al. . | |

*Primary Examiner*—W. Donald Bray
*Attorney, Agent, or Firm*—Emch, Schaffer, Schaub & Porcello Co., L.P.A.

[57] ABSTRACT

A device for splitting wood comprises a rotatable and movable cutting device. A splitting blade is positioned on one end of the cutting device which acts to split the wood when the cutting device is advanced in a direction towards the wood. The cutting device can be rotated to position the splitting blade with respect to the wood to facilitate the desired splitting of the wood. The cutting device is positioned on a positioning carriage which is moved with respect to the wood that is to be split. The positioning carriage is movably positioned on a moveable carriage to further assist in positioning the splitting blade with respect to the wood to effectively and efficiently split the wood.

13 Claims, 9 Drawing Sheets

WOOD SPLITTING DEVICE

The present invention relates to a wood splitting device especially one utilized by commercial or professional wood cutters.

BACKGROUND OF THE INVENTION

Various apparatus for splitting fire wood are known in the art. However, there are few machines which are capable of cutting large diameter logs into fire wood.

Typical wood splitters have a wedge-shape cutting member or a cross-shape cutting member which is forcibly rammed into the wood. Often, however, the wedge-shaped or cross-shaped cutting members become stuck in the piece of wood, especially if the wood is very hard or thick or if insufficient force is used to ram the wedge into the wood. If the blade or wedge jams in the wood, it is a common practice to use a sledge hammer or other heavy object to dislodge the wood from the blade.

Another disadvantage of prior wood cutting apparatus is that the wood cutting apparatus remains stationary while individual pieces of wood to be cut are placed within the path of the traveling ram or wedge. This also involves much labor intensive hauling and positioning of the pieces of wood to be cut within the path of the wood splitting apparatus.

While present day commercial fire wood processors have solved some of these problems, there are limitations to these machines. Most fire wood processors require the wood to be a long straight form. The logs must be fairly straight and usually have a minimum and maximum diameter restriction. The maximum diameter is usually not very large; that is, less than about 30 inches. These processors usually have an apparatus to cut the log to fire wood length. Then, the cut log is forced through a multiple wedge cutting system. This splitting usually leads to many pieces of wood being too small or too large and also leaves a lot of useless debris.

There is a need to have an apparatus to quickly and efficiently split wood into fire wood size pieces that is not greatly limited by length, shape or size.

There is also a need for an apparatus to easily and quickly control the size of the fire wood pieces, greatly eliminating odd sizes and trash.

SUMMARY OF THE INVENTION

The present invention relates to a wood splitting device for cutting vertical pieces of small to large diameter sections of wood.

The present invention relates to a device for splitting wood comprising a rotatable and movable cutting device. A splitting blade is positioned on one end of the cutting device. The splitting blade splits the wood when the cutting device is advanced in a direction towards the wood. The cutting device is capable of being rotated to position the splitting blade with respect to the wood to facilitate the desired splitting of the wood. The cutting device is slideably mounted on a positioning carriage which is moveable in one horizontal direction with respect to the wood that is to be split. The positioning carriage is fixedly mounted on a moveable carriage which is moveable in a different horizontal direction with respect to the wood that is to be split.

An object of the invention is to provide an apparatus to locate and position the splitting blade with respect to the wood.

Another object of the invention is to provide split cut wood from small to large diameter sections of wood.

Another object of the invention is to provide an apparatus which is in the form of a trailer whereby the apparatus can be readily transported.

Another object of the present invention is to provide an apparatus which is capable of cutting multiple sections of tree once each tree section is placed on the trailer.

Another object of the invention is to provide an apparatus capable of efficiently removing the cut logs from the splitting apparatus.

Still another object of the invention is to provide an apparatus which is capable of being operated in an efficient manner.

These and other objects and advantages of the present invention will become apparent from the attached claims, the following detailed description and the accompanied drawings.

DETAILED DESCRIPTION OF THE DRAWINGS

Figure 1:
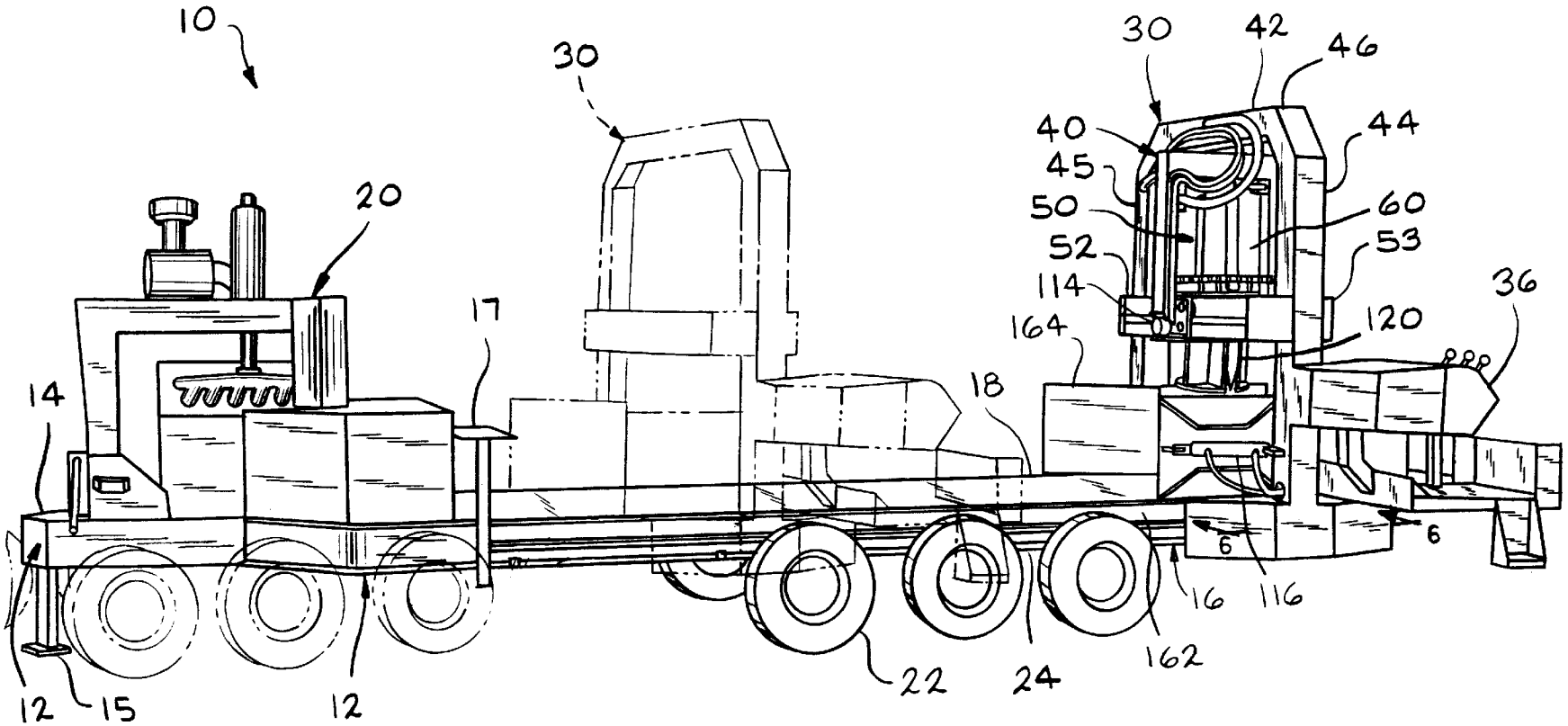
FIG. 1 is a perspective view showing the wood cutting apparatus in a first position and in a second position, in phantom.

Referring now to FIG. 1, a fireplace wood cutting apparatus of the instant invention is generally shown as 10. The apparatus 10 includes a main frame 12 having a first or hitch end 14 and a second or cutting end 16. A movable support 15 is operatively connected to the hitch end 14 such that support 15 can be lowered to the ground so the hitch end 14 can be held in a secure horizontal position. FIG. 1 shows one of the stabilizer legs 17 which are lowered to the ground to support the apparatus 10 when the apparatus is being used. While only one stabilizer leg 17 is shown, it is to be understood that a plurality of stabilizer legs are to be used to hold the apparatus in a horizontal position. The frame 12 further includes a bed 18 which extends in a horizontal manner from adjacent the first or hitch end 14 to the second end 16. An engine or means for supplying power 20 is operatively mounted to the first end 14. A plurality of underslung tandem wheel and axle assemblies 22 are removably connected to the frame 12. The wheel assemblies 22 are operatively connected to the frame 12, as seen in FIG. 1, such that the wheel and axle assemblies 22 are positioned under the bed 18 of the frame 12 when the apparatus 10 is being transported to a work site. The wheel and axle assemblies 22 are moved to a position adjacent the first end 14 when the apparatus 10 is being used to split wood, as shown in phantom in FIG. 1.

A moveable cutting carriage 30 is operatively mounted on the second end 16 of the frame 12. An operator's control station 36 is operatively connected to the moveable cutting carriage 30.

Figure 6:
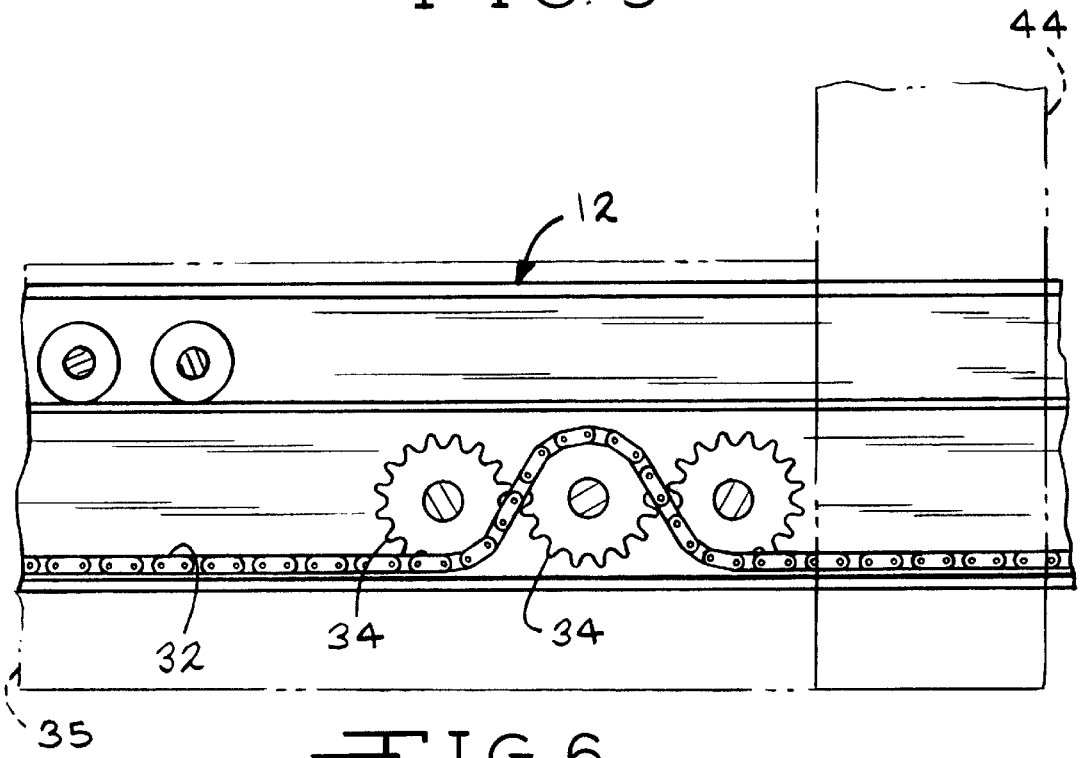
FIG. 6 is a side elevation view, taken along the line 6—6 in FIG. 1 and showing, partially in phantom, a plurality of gears for moving a different portion of the cutting apparatus.

Referring now to FIGS. 1 and 6, the engine 20 is operatively connected to the frame 12 by a drive means such as a chain 32 which extends along a side 24 of the bed 18. It is to be understood that the drive means can comprise a further chain (not shown) on the opposing side of the bed 18. However, for ease of explanation only one chain 32 will be discussed in detail. The chain 32 is fixedly attached at a first end adjacent the first end 14 and at a second end adjacent the second end 16. The chain 32 passes over a plurality of gears 34 which extend from the moveable carriage 30. The engine 20 supplies power to the gears 34 such that the moveable carriage 30 is moved or pulled along the chain 32. The moveable carriage 30 can be moved in a first horizontal direction along the length of the bed 18 toward the first end 14 or in a direction away from the first end 14. The moveable carriage 30 can be stopped at any point along the bed 18 such that the moveable cutting carriage 30 is positioned directly over a piece of wood to be cut. The moveable cutting carriage 30 can be positioned with accuracy at any point along the horizontal bed 18.

Figure 2:
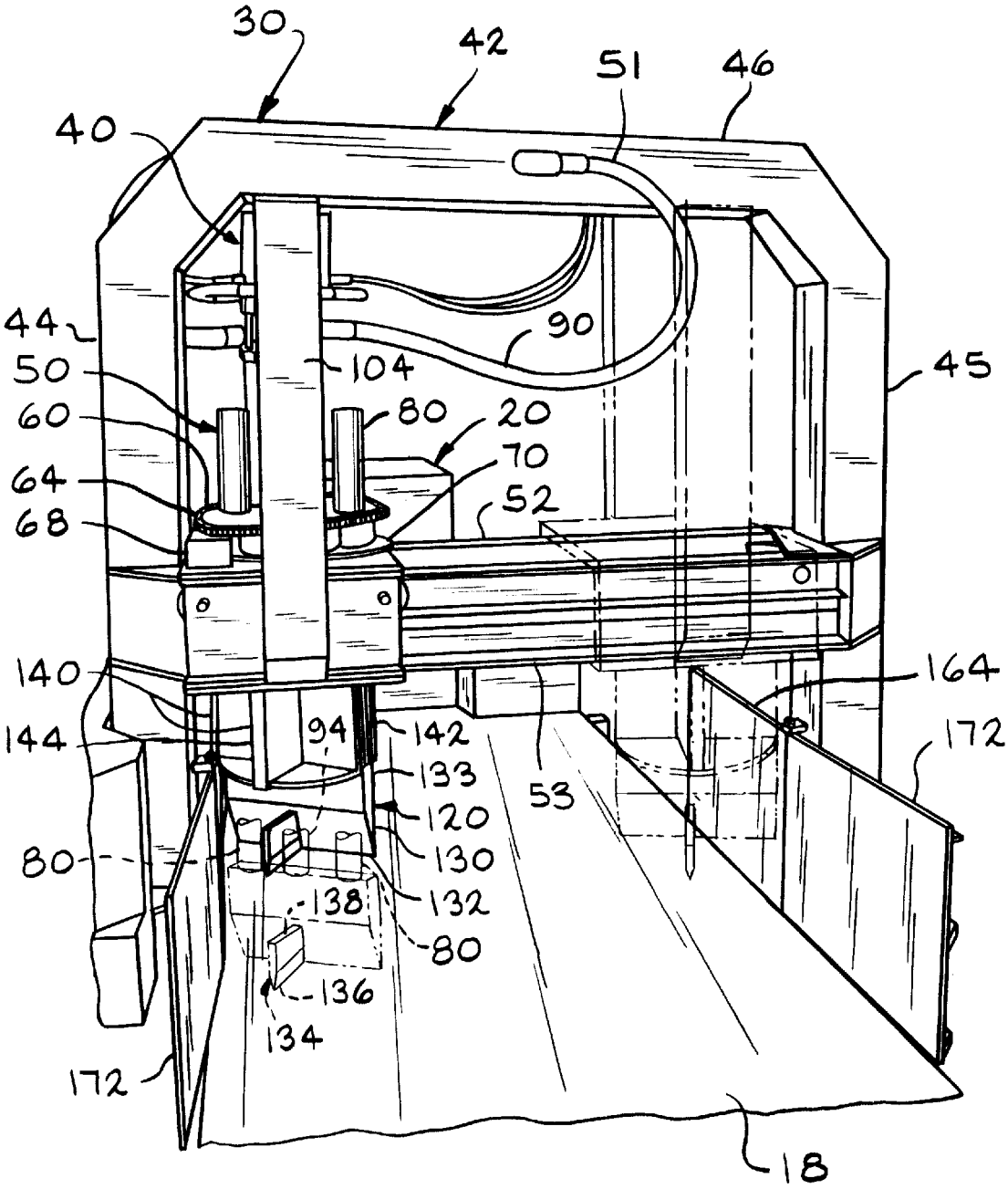
FIG. 2 is a perspective view of a portion of the cutting apparatus showing the apparatus in a middle position and in a down position, in phantom; and, in a first or left position and in a second or right position, in phantom.

Referring now to FIG. 2, the moveable cutting carriage 30 further comprises a positioning carriage 40 and a cutting device 50 operatively mounted to a U-shaped support 42. The support 42 has a pair of vertically extending support portions 44 and 45 and at least one cross portion 46 which operatively connects the top ends of the vertical support portions 44 and 45. The positioning carriage 40 and the cutting device 50 are slideably mounted on horizontally extending cross pieces 52 and 53 which extend from the first vertical support portion 44 to the second vertical support portion 45. The horizontally extending cross pieces 52 and 53 are in a spaced apart and parallel relationship such that the cutting device 50 is mounted in the space between the cross pieces 52 and 53. The cutting device 50 can be slideably moved across the width of the bed 18 such that the cutting device 50 can be stationed at any point on the bed 18 immediately above a piece of wood to be cut. The cutting device 50 is operatively connected to a means 51 for supplying hydraulic power to the cutting device 50. The cutting device 50 is vertically moveable from a first, or retracted, position to an extended, or cutting position, as shown in phantom in FIG. 2. After a first piece of wood is cut into fire wood size pieces, as will be described in further detail below, the cutting device 50 is slideably moved along the horizontal extending cross pieces 52 and 53 to a new position, as shown in phantom.

Figure 3:
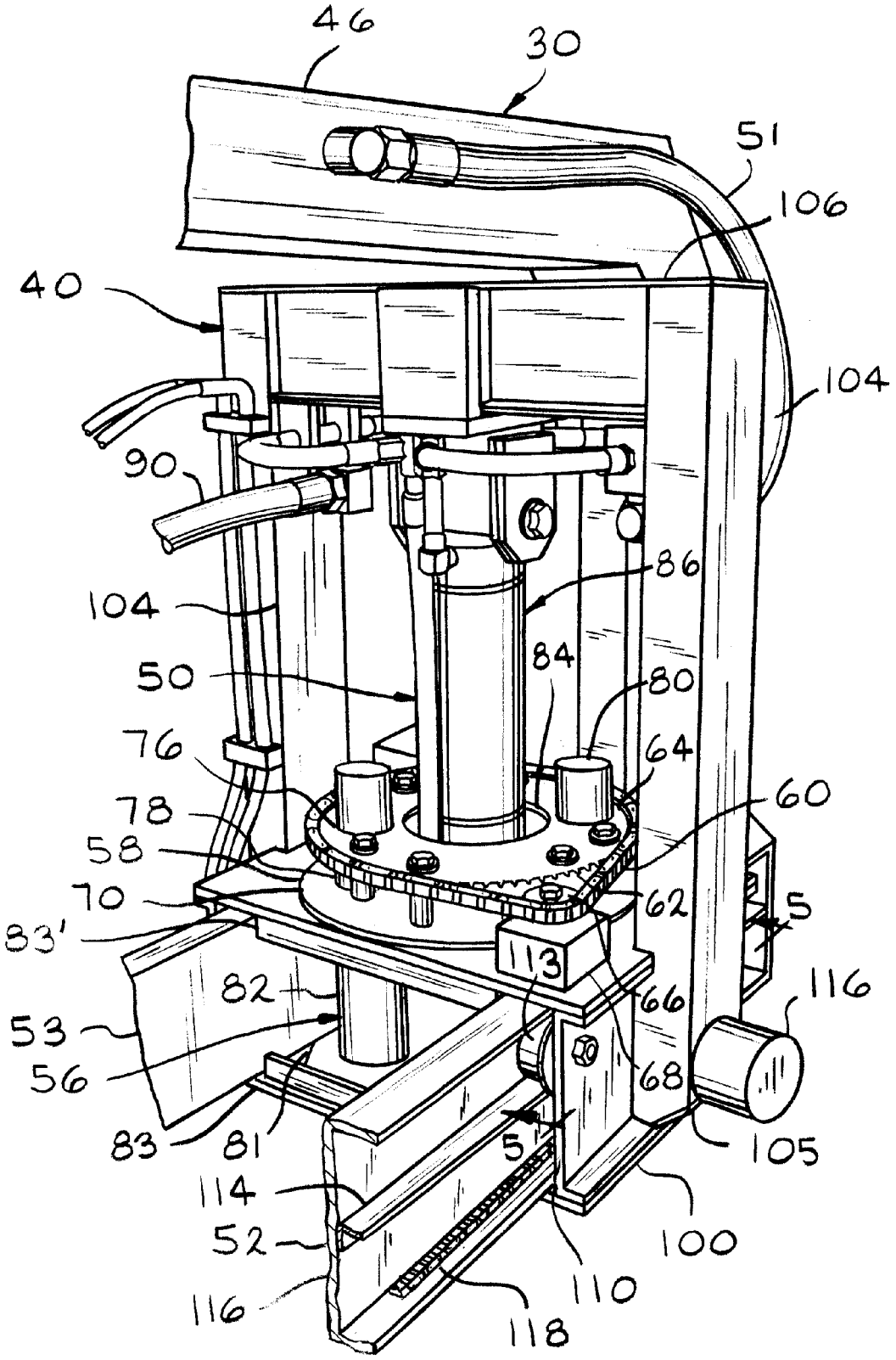
FIG. 3 is a perspective view of a portion of the wood cutting apparatus.

Referring now to FIG. 3, a portion of the cutting device 50 is shown in greater detail. The cutting device 50 comprises at least one rotatable drive member 58 and a driven member 56. In the embodiment shown, the drive member 58 comprises a gear plate assembly 60, a drive motor 68, an underplate assembly 70, and at least one outer hollow cylindrical member 72. In the embodiment shown the drive gear plate assembly 60 has a plurality of teeth 62 which engage a chain 64. The chain 64 operatively extends around a second gear portion 66 which is controlled by the motor 68. The gear plate assembly 60 is operatively connected to a spaced apart underplate assembly 70 by at least one, and preferably two outer hollow cylindrical members 72 which extend in a vertical direction from the gear plate assembly 60 to the underplate assembly 70. In a preferred embodiment, the outer cylindrical members 72 are welded to the gear plate assembly 60 and the underplate assembly 70. The gear plate assembly 60 defines at least one, and preferably at least two, spaced apart openings 76 which are in coaxial alignment with the hollow outer cylindrical members 72. The underplate assembly 70 also defines at least one, and preferably at least two, spaced apart openings 78 which are in coaxial alignment with adjacent openings 76 in the gear plate assembly 60 and are also in coaxial alignment with the hollow outer cylindrical members 72.

A guide shaft 80 extends through each of the openings 76 and 78 of the gear plate assembly 60 and the underplate assembly. Each guide shaft 80 further extends through the driven member 56 which comprises at least one inner cylindrical member 82 which is operatively connected to a lower rotatable member 81 and an upper rotatable member 81'. The inner cylindrical members 82 extend in a vertical direction from the lower rotatable member 81 through the upper rotatable member 81'. In a preferred embodiment, the inner cylindrical members 82 are welded to the upper and lower rotatable members 81 and 81'.

Each inner cylindrical members 82 extends vertically beyond the upper rotatable member 81' and through the adjacent outer cylindrical member 72. The inner cylindrical members 82 extend through the underplate assembly 70 and terminate at the gear plate assembly 60. Thus, each guide shaft 80, inner cylindrical member 82 and outer cylindrical member 72 is in coaxial alignment. The lower and upper rotatable members 81 and 81' and the inner cylindrical members 82 rotate within a support bracket means 83 and 83' which is operatively connected to a housing portion 100.

The gear plate assembly 60 and the underplate assembly 70 each further define central or axially located openings 84 and 85, respectively. The rotatable members 81 and 81' defines central or axially located openings 87 and 87', as seen in FIG. 4.

Figure 4:
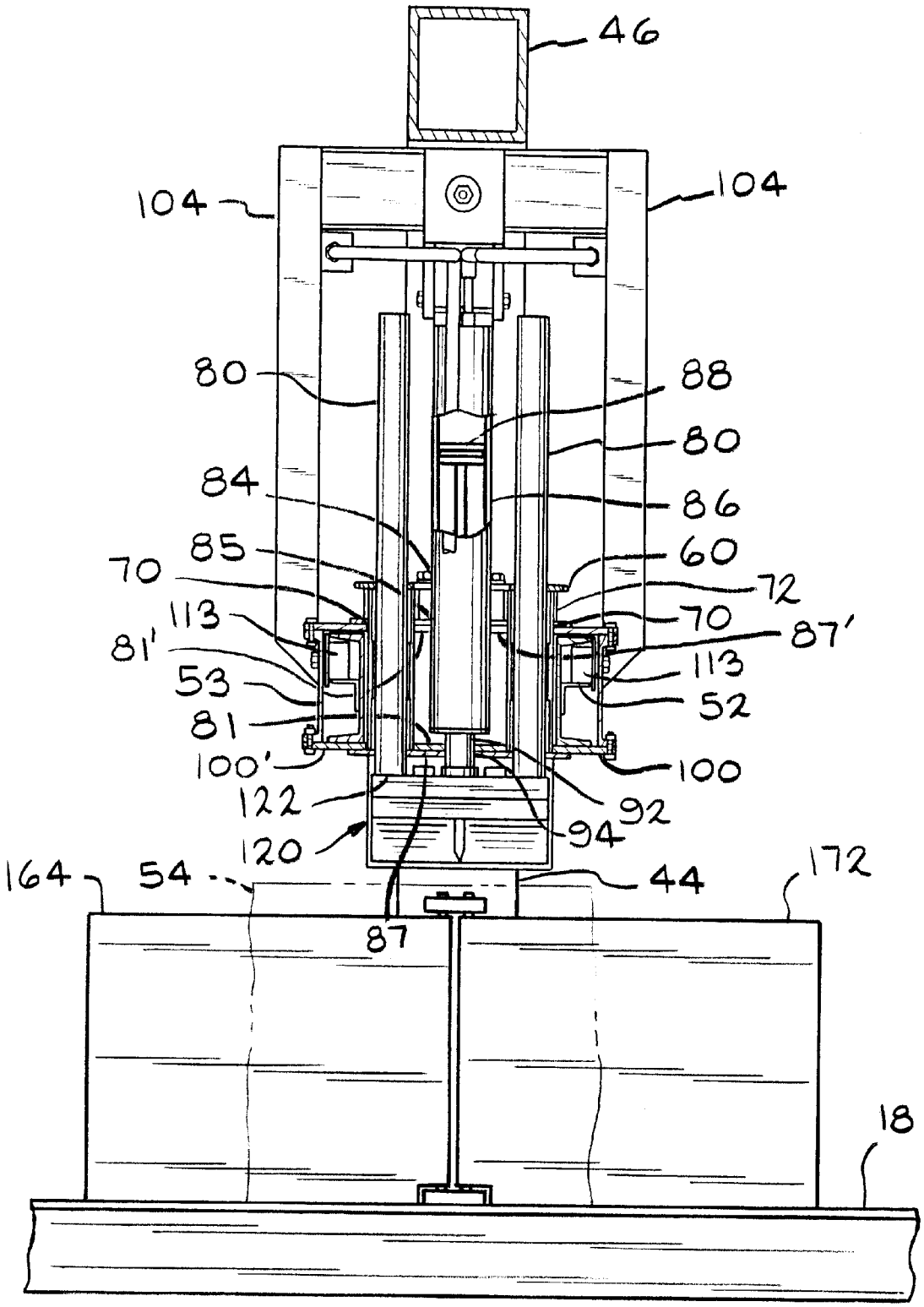
FIG. 4 is a side elevation view, partially broken away, of the cutting apparatus positioned above a log, in phantom.

Referring now to FIGS. 3 and 4, the cutting device 50 comprises, in part, a hydraulic cylinder assembly 86 which moves from a first, or elevated, position to a second, or lowered and cutting, position. The hydraulic cylinder assembly 86 extends through the opening 84 in the gear plate assembly 60, through the opening 85 in the underplate 70 and through the openings 87 and 87' in the rotatable members 81 and 81'. A plurality of hydraulic hoses 90 are operatively connected to the cutting device 50 to provide hydraulic power both on a downward thrust and an upward retraction of the hydraulic cylinder assembly 86. The hydraulic cylinder assembly 86 has a distal end 92 through which extends a hydraulic piston rod 94. The hydraulic piston rod 94 rotates around a vertical axis extending through the hydraulic assembly 86. In operation, the operator activates the motor 68 which causes the gear plate assembly 60, under plate assembly 70 and rotatable members 81 and 81' to rotate about the axis through the hydraulic cylinder assembly 86.

As the gear plate assembly 60, under plate assembly 70 and rotatable members 81 and 81' turn, the outer cylindrical members 72 contact the inner cylindrical members 82 which contact the guide shafts 80. Rotation of the gear plate assembly 60 and under plate assembly 70 cause the rotatable members 81 and 81', guide shafts 80, a cutting blade 120 and, thus the piston rod 94 and piston 88 to rotate in a substantially 360° and infinitely continuous manner in either a clockwise or counterclockwise direction.

The cutting device 50 is mounted within the positioning carriage 40 which further comprises the housing portion 100. The housing portion 100 comprises at least one, and a preferably at least two spaced apart vertically extending portions 104 and a horizontally extending portion 106 connecting the portions 104 to provide support and stability for the positioning carriage 40.

Figure 5:
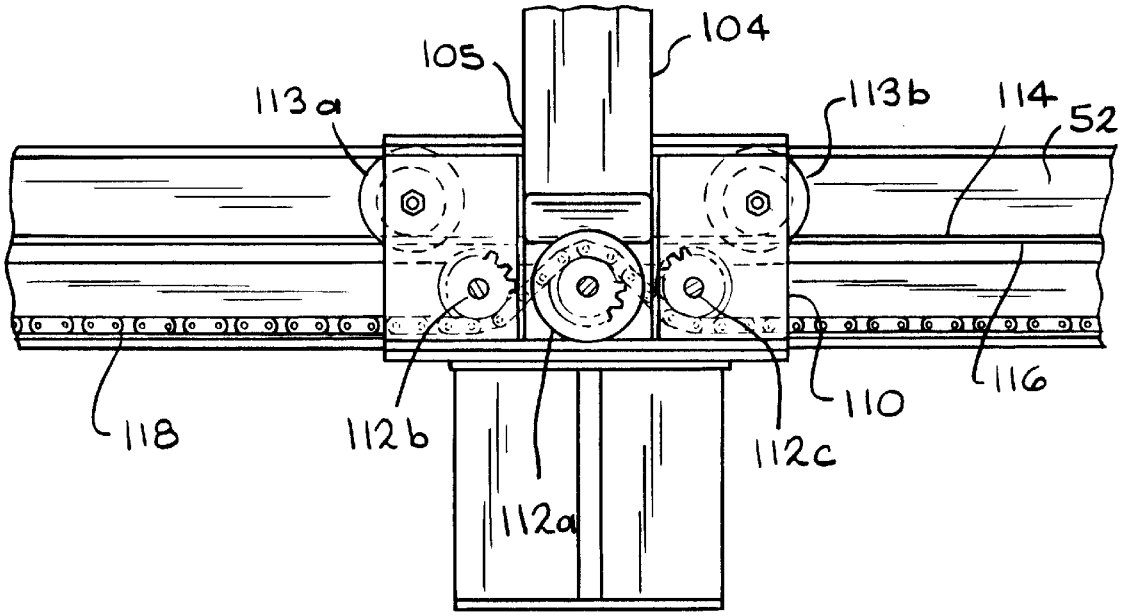
FIG. 5 is a side elevation view, taken along the line 5—5 in FIG. 3 and showing partially in phantom, a plurality of gears for moving a portion of the cutting apparatus.

Referring again to FIG. 3 in connection with FIG. 5, the housing portion 100 further comprises a bracket portion 110 operatively connected to a bottom portion 105 of each vertically extending portion 104. The bracket portion 110 has a plurality of sprockets 112 operatively extending from the bracket portion 110. The bracket portion 110 also has a plurality of rollers 113*a* and 113*b* and are operatively mounted in a spaced apart relationship such that rollers 113*a* and 113*b* move along a rail portion 114 of each cross portion 52 and 53. The sprockets 112 operatively engage a chain mechanism 118. In the embodiment shown, the sprocket 112*a* is a drive sprocket which is operatively connected to a motor 116 which is connected to the power supply 20 while the sprockets 112*b* and 112*c* are idler sprockets. One end of the chain 118 is fixedly mounted to a first end of the cross piece 52 while a second end of the chain 118 is fixedly mounted to a second, opposing end of the cross piece 52. The chain mechanism 118 is thus operatively connected to the power means 20 which allows the positioning carriage 40 to slideably move or be pulled in a horizontal direction across the width of the bed 18 along the cross pieces 52 and 53.

Referring now to FIGS. 2 and 4, the positioning carriage 40 is moved to position the cutting device 50 in an opposed relationship to a piece of wood to be cut 54, as shown in FIG. 4. The cutting device 50 further comprises the cutting or splitting blade 120 which is mounted on distal ends of the guide shafts 80 and the hydraulic piston rod 94 of the hydraulic cylinder assembly 86. It has been found by the inventor herein that a cutting blade having a generally T-shape is especially useful. It shall be understood, however, that various shapes of cutting blades are useful with the present invention and that use of such other shapes is within the contemplated scope of the present invention. In the embodiment shown, the cutting blade 120 has a generally T-shape. The cutting blade 120 comprises a longitudinally extending blade portion 130 which defines a first cutting edge 132 and terminates in a second end 133. The cutting blade 120 further comprises a T-shape portion 134 which is mounted in substantially the center portion of the blade portion 130 and extends in a generally perpendicular direction at a right angle from the blade portion 130. The T-shape blade portion 134 generally has a leading knife shaped end portion 136 and terminates at a second end 138.

The cutting blade 120 can, in a preferred embodiment, be retracted into a housing 140. The housing 140 has extending flanges 142 and 144 such that the blade portions 130 and 134 can be retracted within the housing 140 to dislodge any wood which may be stuck to the cutting blade.

Figure 8:
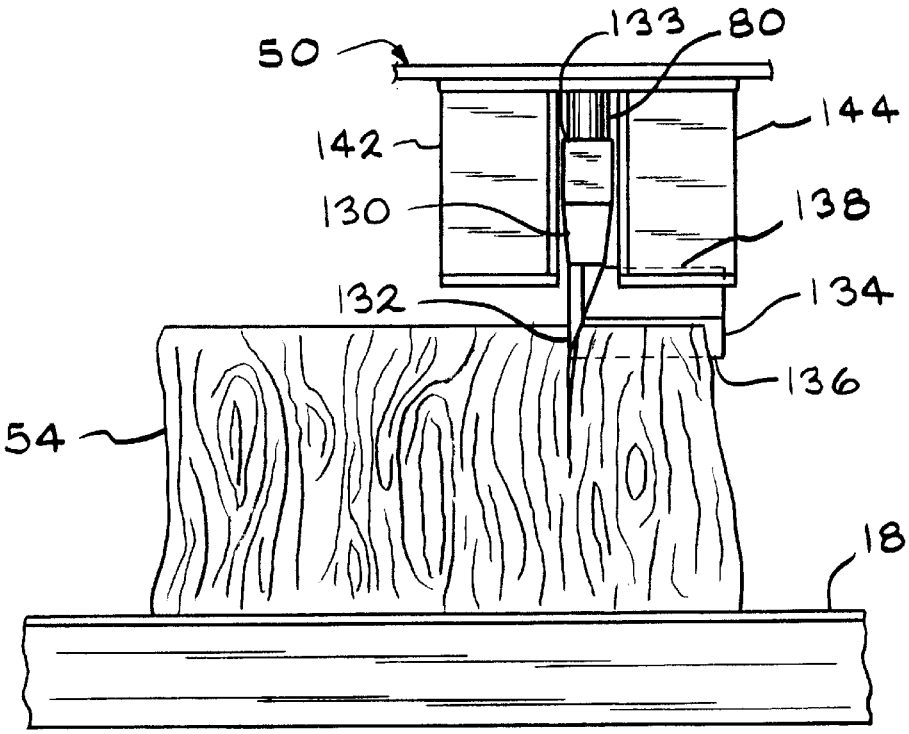
FIG. 8 is a side elevation view, partially in phantom, showing the wood cutting blade in a first or initial cut position.
Figure 9:
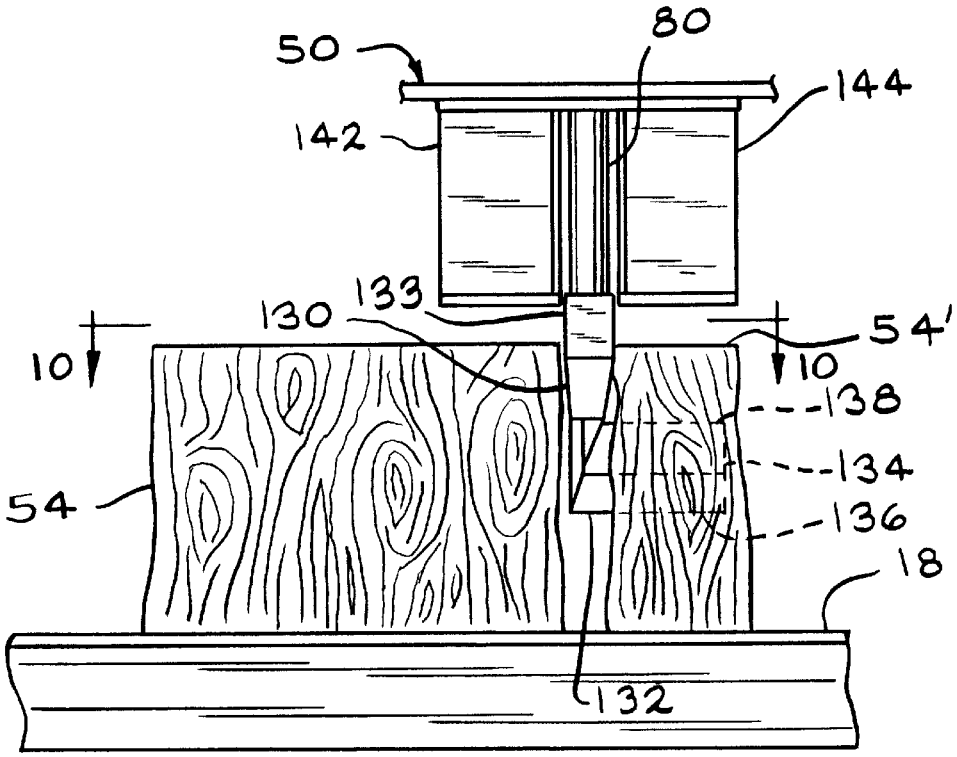
FIG. 9 is a side elevation view, partially in phantom, similar to FIG. 8 showing the blade splitting a portion of the wood from the log.
Figure 10:
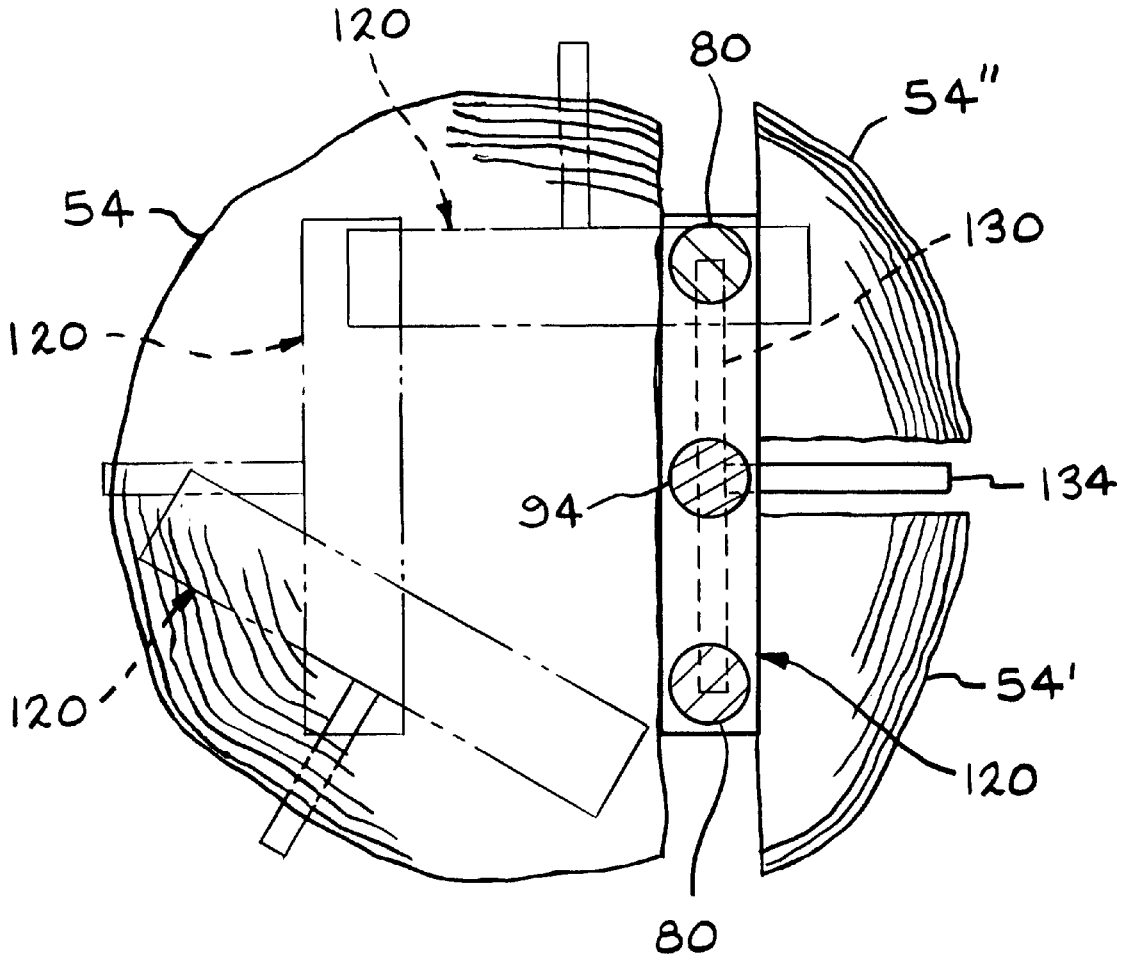
FIG. 10 is a view taken along the line 10—10 in FIG. 9 and also including, in phantom, several of the infinitely possible positions of the wood cutting apparatus.

As best seen in FIGS. 8 and 9, the second end 133 of the blade portion 130 is operatively and securely mounted to the guide shafts 80 and the piston rod 94. As the hydraulic cylinder assembly 86 begins its downward thrust, the leading edge 132 of the blade 130 and the leading edge 136 of the T portion 134 enter the wood 54. The wedge shape of the blade portion 130 forces the wood apart while the cutting device 50 continues to travel in a downward direction. The blade portion 130 and T shape blade portion 134 force at least two sections of the wood apart, causing logs 54' and 54" to be formed, as seen in FIG. 10.

The blade portion 130 and the T shape portion 134 allow the wood to be systematically cut into useable size pieces of wood, without producing substantially any trash or too small pieces of wood. FIG. 10 shows a first cut to form log portions 54' and 54". FIG. 10 also shows, in phantom, several of the infinite positions that the cutting device 50 can be moved and rotated to continue to cut portions of the log 54 into useable fire wood portions. It is to be understood that the operator determines how best to divide the log 54 into useable portions by positioning the cutting device 50 in an adjacent, yet spaced apart, relationship from a top profile portion of the log 54.

In operation, a plurality of vertically positioned logs are placed on the bed 18 of the apparatus 10 by any suitable means. The operator cuts a first log into fire wood sections by rotating the cutting device 50 about a 360° axis through the piston rod 94 to find a desired first cutting position. The cutting device 50 is engaged such that the hydraulic assembly 86 causes the cutting blade 120 to cut the wood. The cutting device 50 is again rotated about the axis through the piston rod 94 to make any additional cuts. The operator can also positions the cutting device 50 at a second cutting position by moving the positioning carriage 40 in a first horizontal direction across the width of the bed 18 by sliding the positioning carriage 40 along the cross pieces 52 and 53 and/or by slideably moving the cutting carriage 30 in a second horizontal direction along the length of the bed 18. Once the cutting device 50 is positioned in a desired position above the log, the operator engages the cutting device 50 to move in a rapid vertically downward direction, splitting second log into sections. The operator continues to reposition and rotate the cutting device 50 in a manner as shown in FIG. 10 until the log is sufficiently cut into pieces of useable fire wood.

Figure 7:
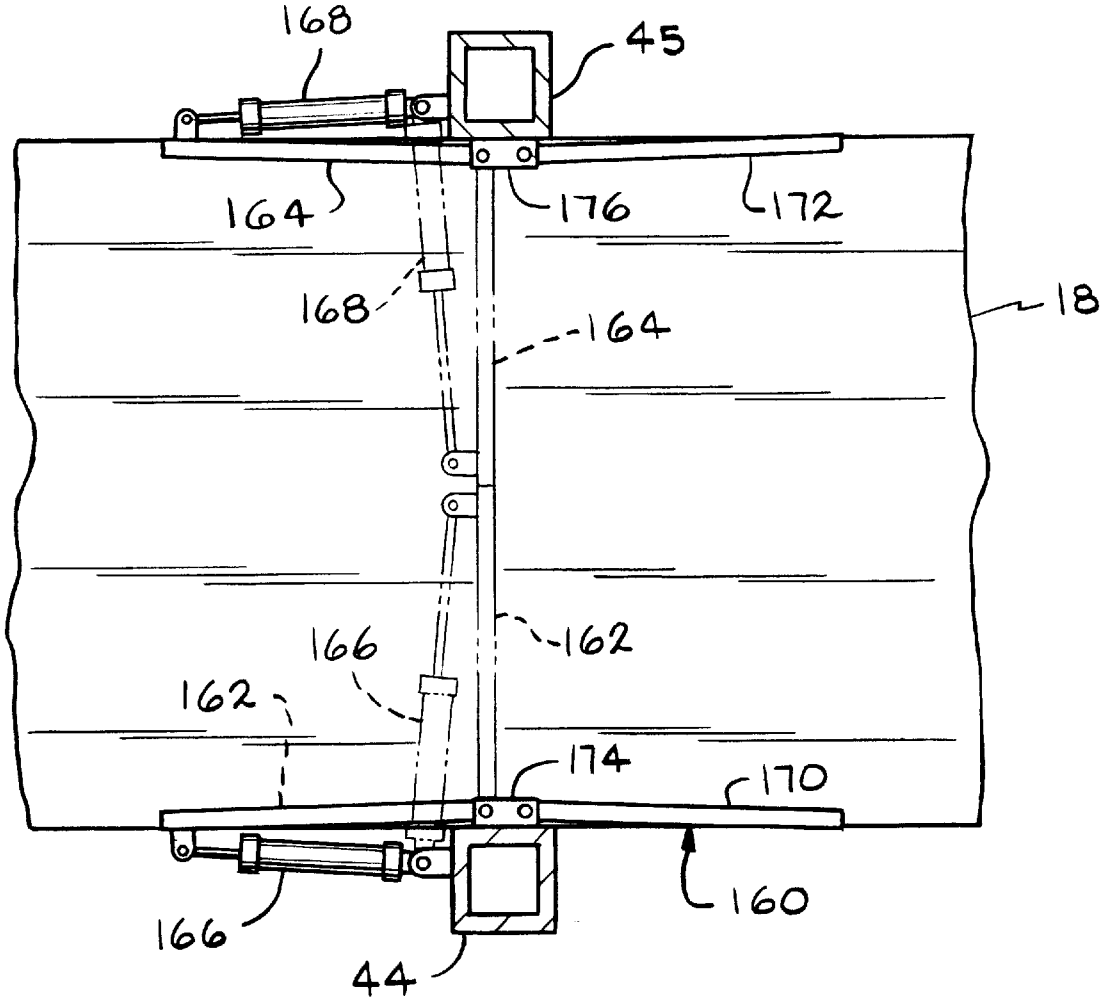
FIG. 7 is a plan view of a portion of the wood cutting apparatus, showing gates in an open position and in a closed position, in phantom.

Once the logs positioned on the bed 18 have been cut into useable fire wood portions, a removal means 160 is activated by the operator to remove the logs from the bed 18. Referring now in particular to FIGS. 1, 2, 4 and 7, the gate or removal means 160 is generally shown. The gate means 160 is operatively mounted to the moveable carriage 30. The gate means 160 comprises a first moveable gate 162 and a first guiding gate 170 and an opposing, or second moveable gate 164 and an opposing or second guiding gate 172. The first moveable gate 162 and first guiding gate 170 are operatively connected to the vertical support portion 44 while the second moveable gate 164 and the second guiding gate 172 are operatively connected to the vertical support portion 45. The first moveable gate 162 is operatively connected to a first moving means 166 such as a hydraulic rod and cylinder. Similarly, the second moveable gate 164 is operatively connected to a second moving means 168 such as a hydraulic rod and cylinder. The first guiding gate 170 is mounted to the vertical support 44 and is in an opposed and substantially parallel relationship to the first gate 162 when the gate 162 is in an open position. Similarly, the opposing guiding gate 172 is mounted to the vertical support 45 and in an opposed and parallel relationship to the second gate 164 when the second gate 164 is in an open position. Gates 162 and 164 are pivotally mounted on brackets on 174 and 176, respectively, such that the gates 162 and 164 can be pivotally rotated to the closed position, as shown in phantom in FIG. 7, by the first and second moving means 166 and 168, respectively. The moveable gates 162 and 164 are operatively connected to the power means 20 in a suitable manner such that the operator can close the gates 162 and 164 by bringing the gates 162 and 164 into a substantially closed or perpendicular relationship with respect to the guiding gates 170 and 172, as best seen in FIG. 7. After a supply of logs has been split, the operator engages the power means 20 to close the gates 162 and 164. The operator then moves the moveable cutting carriage 30 in a direction away from the engine 20. As the moveable cutting carriage 30 moves in a rearward direction, the gates 162 and 164 contact the cut or split logs 54'. The logs are then slideably moved along the bed 18 to the rear end 16 where the pieces of wood can be split into smaller pieces, if needed, by a further cutting apparatus 200, as discussed in detail below, or slideably moved off the end of the bed 18 to a suitable transport mechanism.

Figure 11:
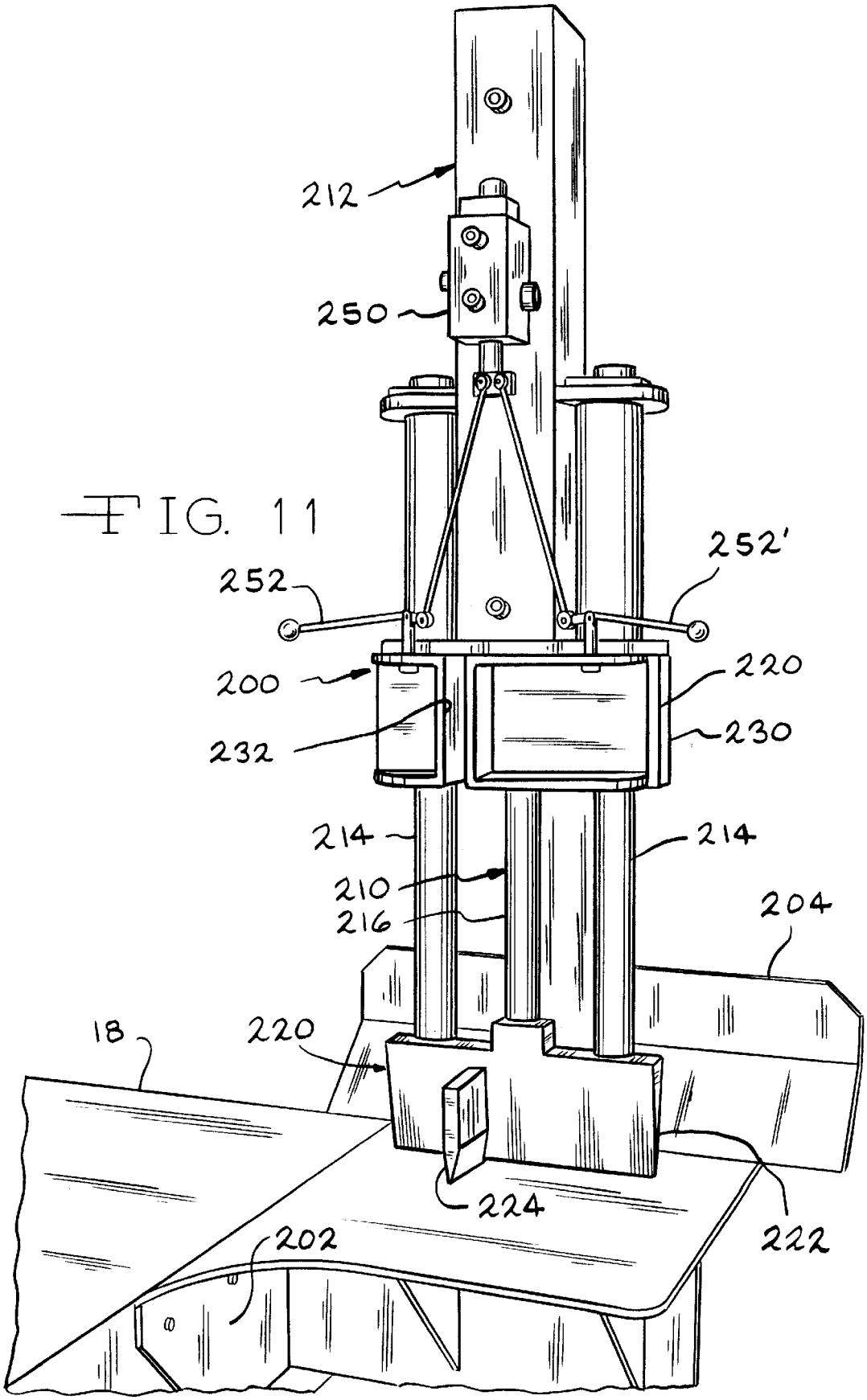
FIG. 11 is a perspective view of an additional wood cutting apparatus that is mountable on the wood cutting apparatus in order to additionally cut portions of wood into smaller portions.

In various embodiments, a further log cutting device 200 can be operatively mounted to or against the rear end portion 16 of the bed 18. FIG. 11 shows an embodiment having the additional cutting device 200 mounted on the end portion of the bed 18 by a suitable bracket 202. In the embodiment shown, a guide edge 204 is mounted in a substantially vertical position with respect to the bracket 202 and bed 18. The cutting device 200 generally includes a rod and piston assembly 210 operatively mounted within a housing 212. At least one and preferably two guide shafts 214 are positioned in an opposed and parallel relationship to a rod 216 of the rod and piston assembly 210. The rod 216 and guide shafts 214 are securely mounted to a cutting blade 220. It has been found by the inventor herein that a cutting blade having a generally "small t" shape is especially useful. It should be understood, however, that various shapes of cutting blades are useful with the present invention and that use of such other shapes is within the contemplated scope of the present invention. In the embodiment shown in FIG. 11, the cutting blade 220 has a small "t" shape having a first wedge blade shape portion 222 and an opposing "t" shape blade portion 224 which is mounted in an off set manner at a perpendicular or right angle to the blade portion 222. In a preferred embodiment, the blade assembly 220 can be retracted within a housing 230 which define channels 232 for receiving portions of the blade assembly 220 to dislodge any stuck portions of wood. The cutting device 200 is operatively connected to a control valve means 250 having at least one lever 252 and/or 252'. The control valve means 250 is operatively connected to the engine 20 which supplies power to the rod and piston assembly 210. The operator can grasp a lever 252 or 252', depending on which end of the device the operator stands or is positioned, in order to supply power and engage the log cutting device 200.

While specific embodiments of the invention have been shown for the purposes of illustration, it will be understood that those skilled in the art may make various modifications. Thus, the scope of the invention should be determined by a review of the appended claims including reasonable equivalents thereof.

I claim:

1. A device for splitting wood comprising a rotatable and movable cutting device 50;

a splitting blade 120 positioned on one end of the cutting device 50, the cutting device including a rotatable drive member 58 for rotating the splitting blade 120 with respect to the wood, a hydraulic assembly 86 operatively connected to the splitting blade 120 for advancing the splitting blade 120 in a direction towards the wood, and the splitting blade 120 splitting the wood when the cutting device 50 is advanced in a direction towards the wood, the cutting device 50 being rotated and horizontally moved to position the splitting blade 120 with respect to the wood to facilitate the desired splitting of the wood.

2. The device of claim 1 wherein the cutting device 50 is moveably positioned on a positioning carriage 40 whereby the positioning carriage is moveable in a first horizontal direction with respect to the wood that is to be split in order to position the splitting blade in a desired location with respect to the wood that is to be split.

3. The device of claim 2 wherein the positioning carriage 40 is movably positioned on a moveable carriage 30 whereby the moveable carriage 30 being moveable in a second horizontal direction with respect to the wood that is to be split to further assist in positioning the splitting blade 120 with respect to the wood to effectively and efficiently split the wood.

4. A device for splitting wood comprising a rotatable and movable cutting device 50;

a splitting blade 120 positioned on one end of the cutting device 50, the cutting device including a rotatable drive member 58 for rotating the splitting blade 120 with respect to the wood, a hydraulic assembly 86 for advancing the splitting blade 120 in a direction toward the wood, the cutting device 50 being movably positioned on a positioning carriage 40 whereby the positioning carriage 40 is moveable in a first horizontal direction with respect to the wood that is to be split in order to position the splitting base 120 in a desired location with respect to the wood that is to be split, the positioning carriage 40 being movably positioned on a moveable carriage 30 which is moveable in a second horizontal direction with respect to the wood that is to be split to further assist in positioning the splitting blade 120 with respect to the wood to effectively and efficiently split the wood, and the moveable carriage 30 being operatively mounted on a frame 12, the moveable carriage 30 being operatively connected to at least one chain 32, the chain 32 passing over a plurality of gears mounted on a side portion 35 of the moveable carriage 30 such that the moveable carriage 30 is moveable in a direction toward a first end of the frame or away from the first end of the frame, whereby the moving carriage 30 can be stopped at any point such that the moveable cutting carriage can be directly positioned over a piece of wood to be cut.

5. The device of claim 4, wherein the moveable carriage 30 comprises first and second horizontally extending cross pieces 52 and 53 wherein the cutting device is operatively mounted on the cross pieces 52 and 53 of the moveable carriage 30.

6. The device of claim 4, wherein the rotatable drive member 58 is operatively connected to a driven member 56, the driven member 56 being operatively connected to at least one guide shaft 80 which is operatively connected to the splitting blade 120.

7. The device of claim 6, wherein the drive member 58 comprises, at least one gear plate assembly 60 having a plurality of teeth which engage a chain 64, the chain 64 operatively connected to a power means 68, an underplate assembly 70 operatively connected to the gear plate 60 by at least one outer cylindrical member 72, the gear plate assembly 60 defining at least one spaced apart opening 76 and the underplate assembly 70 defining at least one spaced apart opening 78 which is co-axial alignment with the opening 76 in the gear plate assembly 60, the opening 76 and 78 being in coaxial alignment with the outer cylindrical member 72, wherein each guide shaft 80 extends through each of the openings 76 and 78 and each outer cylindrical member 72, the gear plate assembly 60 and underplate assembly 70 each further defining centrally located axial openings 84 and 85, respectively, for receiving a hydraulic cylinder assembly 86 which extends through the opening 84 in the gear plate assembly 60 and through the opening 85 in the underplate assembly 70, wherein activation of the power means 68 causes the gear plate assembly 60 and underplate assembly 70 to rotate about the axis through the hydraulic cylinder assembly 86, and whereby the rotation of the gear plate assembly 60 and underplate assembly 70 cause the guide shafts 80 and the splitting blade to be rotated.

8. The device of claim 7, wherein the cutting device 50 further comprises the driven member 56 having lower and upper rotatable members 81 and 81' connected by at least one inner cylindrical member 82, the inner cylindrical members 82 being in co-axial alignment with the outer cylindrical members 72 of the drive member 58 whereby rotation of the drive member 58 causes the outer cylindrical members 72, the inner cylindrical members 82 and the guide shafts 80 to be rotated.

9. The device for splitting wood of claim 8, wherein the cutting device 50 is mounted within a housing portion 100 of the positioning carriage 40, the housing portion 100 comprising spaced apart vertically extending portions 104, an horizontally extending portion 106 between the vertically extending portions 104, and a bracket portion 110 operatively connected to one of the vertically extending portions 104, the bracket portion 110 having a plurality of sprockets 112 operatively extending from the bracket portion 110, the sprockets 112 engaging a portion of a chain mechanism 118, the sprockets 112 operatively being connected to power means 20 which allows the cutting device 50 to be pulled along the chain mechanism 118 and to be slideably moved along the cross pieces 52 and 53 of the moveable carriage 30.

10. The device of claim 1, wherein the cutting device comprises a T-shaped cutting blade 120, the cutting blade 120 comprising a longitudinally extending blade portion 130 which defines a first cutting edge 132 and which terminates in a second end 133, the cutting blade 120 further comprising an extending portion 134 which is mounted and is substantially a central portion of the blade portion 130 and extending in a generally perpendicular direction at a right angle from the blade portion 130, the blade portion 134 generally having a leading knife shaped end portion 136 and terminating at a second end 138.

11. The device of claim 3, wherein the moveable carriage further comprises a gate or removal means 160, the gate removal means comprising a first moveable gate 162 and an opposable second moving gate 164 and a first guiding gate 170 and an opposable second guiding gate 172;

the first moveable gate 162 and first guiding gate 170 being operatively connected to a vertical support portion of the moveable carriage 30 while the opposing moveable gate 164 and the opposing guide gate 172 are operatively connected to a second vertical support portion of the moveable carriage 30;

the gate 162 being operatively connected to a moving means 166 and the gate 164 being operatively connected to a second moving means 168;

the guiding gate 170 being mounted in an opposed and substantially parallel relationship to the gate 162 when the gate 162 is in an open position;

the opposing guiding gate 172 being mounted in an opposed and parallel relationship to the gate 164 when the gate 164 is in an open position;

the moveable gates 162 and 164 being operatively connected to a control means whereby the moveable gates 162 and 164 are closable by bringing gates 162 and 164 in a substantially closed or perpendicular relationship with respect to the guiding gates 170 and 172; and whereby the moveable cutting carriage 30 is moveable in a direction such that the closed gates 162 and 164 contact cut or split pieces of wood and slideably move the cut or split pieces of wood along a horizontal bed 18 of the device.

12. The device for splitting wood of claim 1 further comprising an additional log cutting apparatus 200 operatively mounted in a space apart relationship to the wood splitting device, the second cutting apparatus 200 comprising a rod and piston assembly 210 mounted within a housing 212, at least one guide shaft 214 positioned in an opposed relationship to the rod and piston assembly 210;

the rod and piston assembly 210 and guide shaft 214 being securely mounted to a cutting blade 220, the log cutting device 200 further including a control valve means 250 operatively connected to a power means 20 which supplies power to the rod and piston assembly 210.

13. The device of claim 12, wherein the cutting blade 220 has a first wedge shape blade portion 222 and an opposing small "t" shaped blade portion 224 which is mounted in a perpendicular or right angled to the blade portion 222.

* * * * *